US005104139A

United States Patent [19]

Brischoux

[11] Patent Number: 5,104,139

[45] Date of Patent: Apr. 14, 1992

[54] DEVICE FOR MOUNTING A SKI BOOT ON A SKI

[75] Inventor: Jean-Claude Brischoux, Annecy Le Vieux, France

[73] Assignee: Salomon S. A., Chavanod, France

[21] Appl. No.: 631,162

[22] Filed: Dec. 20, 1990

[30] Foreign Application Priority Data

Dec. 20, 1989 [FR] France ..... 89 16917

[51] Int. Cl.[5] ..... A63C 9/00

[52] U.S. Cl. ..... 280/607; 267/153; 280/636

[58] Field of Search ..... 280/602, 607, 617, 618, 280/636; 267/153, 292

[56] References Cited

U.S. PATENT DOCUMENTS 4,294,460 10/1981 Kirsch ..... 280/607
4,979,761 12/1990 Rohlin ..... 280/618 X
5,026,086 6/1991 Guers et al. ..... 280/607

FOREIGN PATENT DOCUMENTS 3818569 4/1989 Fed. Rep. of Germany ..... 280/607

*Primary Examiner*—Andres Kashnikow
*Assistant Examiner*—Michael Mar
*Attorney, Agent, or Firm*—Pollock, Vande Sande & Priddy

[57] ABSTRACT

A device for mounting a ski boot (2) on a ski (1), comprising a longitudinal intermediate support plate (5), on the two end sections of which two bindings (3, 4) are mounted, and a layer of an elastic shock-absorbing material (6) inserted between the intermediate support plate (5) and the upper surface of the ski (1). The layer of elastic shock-absorbing material (6) has a localized stiffness (R) which decreases (or increases) progressively and uniformly beginning at a single intermediate zone of the layer of shock-absorbing material (6), where the thickness value is greatest (or least), and extending in the direction of each of the two ends of this layer.

10 Claims, 2 Drawing Sheets

DEVICE FOR MOUNTING A SKI BOOT ON A SKI

FIELD OF THE INVENTION

The present invention relates to a device for mounting a ski boot on a ski.

BACKGROUND OF THE INVENTION

During alpine skiing, the boot of a skier is held in position between two safety bindings, i.e., a front stop holding the front end of the boot, and a heel piece holding the rear end of the boot. Because these two bindings are generally mounted on the upper surface of the ski using screws, during skiing the shocks and vibrations generated by the unevenness of the ground are transmitted directly to the skier. This constitutes a problem, since shocks and vibrations hinder the steering of the ski, are unpleasant for the skier and ultimately fatigue him.

To overcome this problem, a proposal such as the one described in International Patent Application No. WO 83/03360 has already been offered for mounting the front and rear bindings on an intermediate support plate and for inserting between this support plate and the upper ski surface a layer of elastic shock-absorbing material. In fact, this mounting device allows the layer of shock-absorbing material to absorb the shocks and vibrations generated during skiing, and thus to make skiing.

SUMMARY OF THE INVENTION

The present invention relates to improvements made in this mounting device so as to distribute the pressure exerted by the skier's boot on the ski optimally and longitudinally by means of the layer of shock-absorbing material.

For this purpose, this device for mounting on a ski a ski boot held in position between two safety bindings immobilizing the front and rear of the boot, respectively, which comprises an intermediate longitudinal support plate on the two end sections of which the two bindings are mounted and in which a layer of an elastic shock-absorbing material is inserted between the intermediate support plate and the upper surface of the ski, is characterized by the fact that the layer of elastic shock-absorbing material has a localized stiffness which decreases (or increases) progressively beginning at a single intermediate zone of the layer of shock-absorbing material in which the stiffness is maximal (or minimal) and extending toward each of the two ends of this layer.

The variation in localized stiffness of the layer of shockabsorbing material, which may be continuous or discontinuous, is obtained by selecting physical properties of the layer of shockabsorbing material which are variable longitudinally.

BRIEF DESCRIPTION OF THE DRAWINGS

In order that the invention may be more clearly understood, several embodiments thereof will be described below by way of example with reference to the attached drawings in which.

DESCRIPTION OF THE PREFERRED EMBODIMENTS

Figure 1:
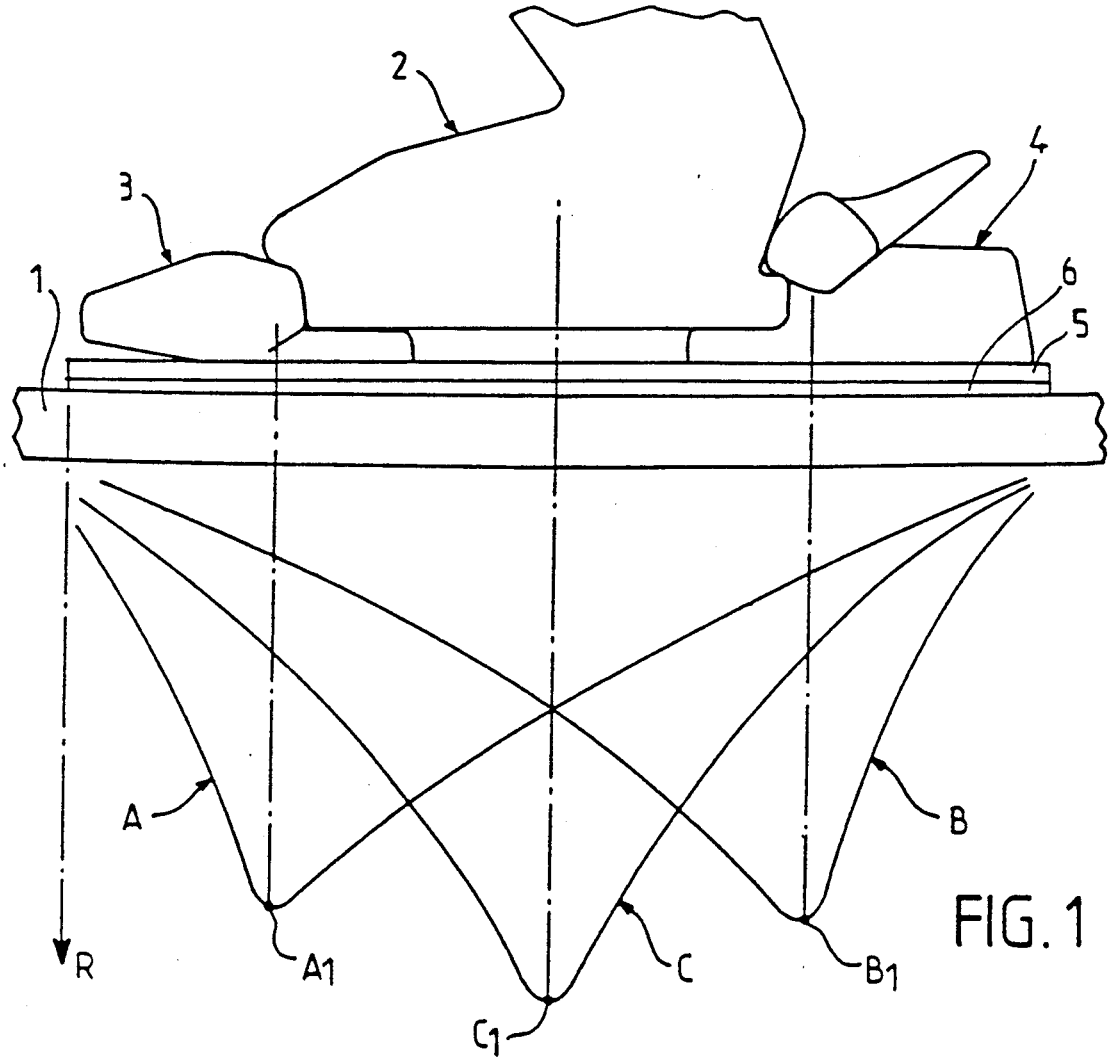
FIG. 1 is a schematic elevated view of a boot immobilized on a ski using a mounting device according to the invention.

The mounting device according to the invention, shown schematically in FIG. 1, is designed to immobilize a ski boot 2 on a ski 1. This ski boot is held in place between two safety bindings, i.e., a front stop 3 holding the front end of the boot 2 in place, and a heel piece 4 holding the rear extremity of the boot in position. The front stop 3 and the heel piece 4 are fastened on the two opposite ends, respectively, of a common rectangular support plate 5 which is longitudinally elongated, and this common support plate 5 is supported, in turn, on the upper surface of the ski 1 by means of a layer 6 of a rectangular elastic shock-absorbing material of uniform thickness. This layer of elastic shock-absorbing material 6 is glued to the upper surface of the ski 1 and beneath the lower surface of the common support plate 5. Furthermore, the two longitudinal ends of the common support plate 5 may be free, as illustrated in the drawings, or they may be fastened to the ski using any suitable means. The support plate 5 may also be free laterally, or else held in place laterally using a guide device.

According to the present invention, the layer 6 of shockabsorbing material has a thickness which is uniformly variable longitudinally, from a maximum (or minimum) thickness in a single intermediate zone of the layer 6 up to a minimum (or maximum) value at the ends of this layer. FIG. 1 illustrates, merely by way of example, three curves A, B, and C, representing the variation in thickness R extending longitudinally. Curve A corresponds to the case of a layer 6 of shock-absorbing material having a maximum thickness at point A1 corresponding substantially to the zone of support of the metatarsals, i.e., the front part of the boot 2. Curve B corresponds to a layer 6 whose thickness is greatest at point B1 corresponding to the zone of support of the heel of the boot 2. Finally, curve C corresponds to a layer 6 whose thickness is greatest at point C1 corresponding substantially to the middle of the sole of the boot.

The longitudinal variation in thickness of the layer 6 of elastic shock-absorbing material may be obtained in different ways. FIGS. 2 to 6 illustrate different embodiments of the layer 6 of variable thickness.

Figure 2:
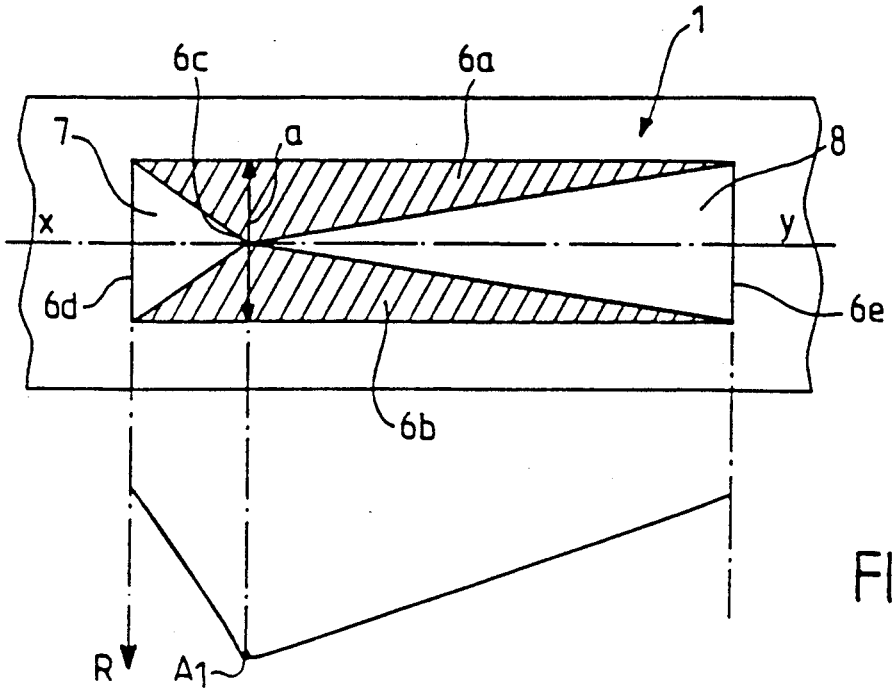
FIG. 2 is a horizontal cross-section of one embodiment of the layer of shock-absorbing material.

In the embodiment shown in FIG. 2, the entirety of the layer 6, which has maximum thickness at point A1 in the zone of the metatarsals, is constituted by a single elastic material having a given thickness, and its functional width, i.e., its transverse dimension, varies longitudinally. Seen in horizontal cross-section, the layer 6 of shock-absorbing material is composed of two triangular blocks **6*a*, 6*b* which are symmetrical in relation to the longitudinal axis x--y of layer 6 and have a common vertex 6*c* lying on the axis x--y corresponding to the point A1 of the thickness curve, and two sides parallel to the longitudinal axis x--y. The triangular spaces 7, 8 delimited by the two triangular blocks 6*a*, 6*b* may be left empty, as shown in FIG. 2, or they may be filled with a foam-type substance having virtually no thickness. Because of this structure, the front space 7 has the shape of an isosceles triangle converging rearward and a rear vertex 6*c*, while the rear space 8 has the shape of an isosceles triangle converging forward and a vertex 6*c*; it is more elongated than the front triangular space 7**.

Given this structure, the width of the cumulative transverse section of the two blocks 6a, 6b of material having a pre-determined thickness increases progressively from a very small or zero width at the forward frontal surface 6d of the layer 6 to a maximum value in the transverse plane passing through the common vertex 6c and corresponding to the maximum A1 of the thickness-variation curve R, and the width of this cumulative transverse section then decreases progressively until it attains a very small or zero value in the plane of the rear frontal surface 6e of the layer 6.

In a reverse arrangement, if a minimum rather than a maximum thickness is desired at point A1, the layer 6 is produced by providing two blocks of elastic material to fill the triangular spaces 7, 8 and by leaving empty or filling triangular spaces 6a, 6b with foam.

Figure 3:
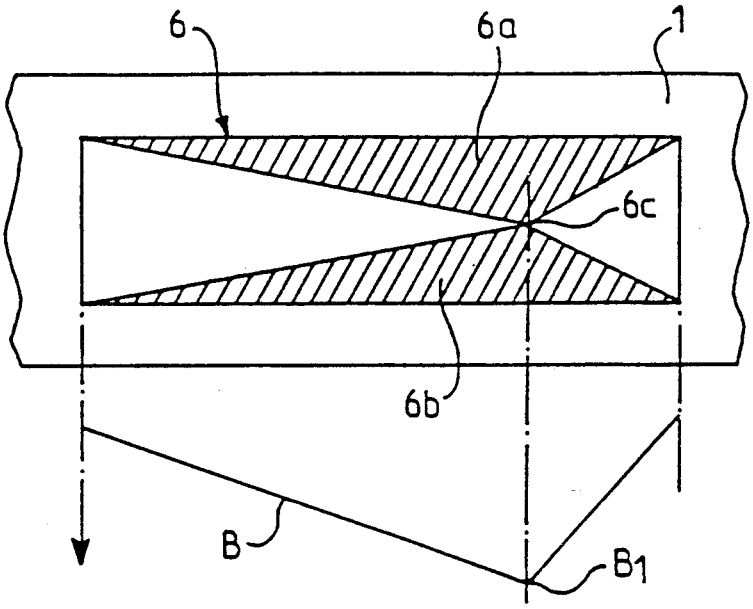
FIGS. 3, 4, 5, and 6 are horizontal cross-section views of further embodiments of the layer of shock-absorbing material.

FIG. 3 illustrates a embodiment in which the common vertex 6c of the two triangular blocks 6a, 6b is located in the rear section of the layer 6, in the zone of support for the heel of the ski boot. This vertex 6c corresponds to the point B1 of the curve B giving the maximum value of thickness R.

Figure 4:
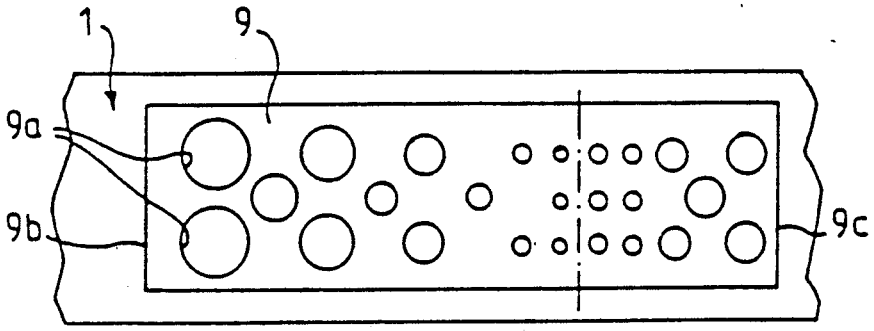

In the embodiment shown in FIG. 4, the variation in stiffness of the layer 9 of elastic shock-absorbing material, this layer being constituted, over its entire length, by a single material of pre-determined thickness, is obtained by providing within this layer 9 holes 9a whose sizes vary longitudinally. The holes 9a which are closest to the forward frontal surface 9b and the rear frontal surface 9c of the layer 9 are the largest, so as to produce only slight stiffness in the layer 9 at these locations. Furthermore, the size of the holes 9a decreases progressively up to the intermediate zone (point B1 of curve B, for example), where the stiffness must be greatest. In this intermediate zone, the holes 9a are smallest, or they may even be omitted.

According to one embodiment making it possible to obtain a minimum stiffness in an intermediate zone, the size of the holes 9a decreases progressively from this intermediate zone in the direction of each frontal surface 9b, 9c.

Figure 5:
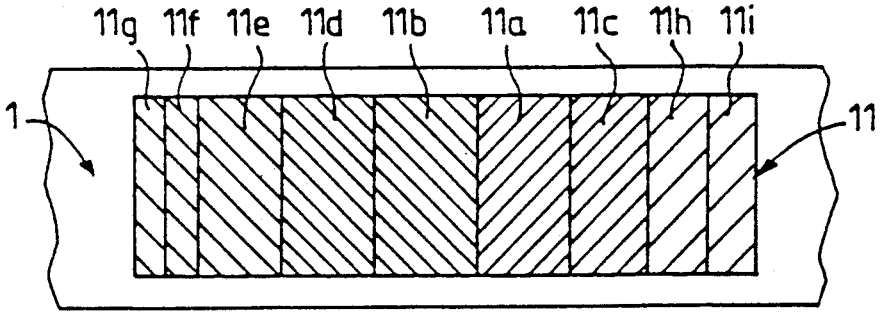

In the embodiment shown in FIG. 5, the layer 11 of elastic shock-absorbing material is constituted by a succession of rectangular blocks 11a, 11b, 11c, 11d, 11e, 11f, 11g, 11i having the same extension in the transverse dimension of the ski, attached to each other in the longitudinal dimension of the ski, and having different stiffnesses. The intermediate block 11a located in the zone in which the layer of shock-absorbing material 11 must have the greatest stiffness, is made of a very stiff elastic material. Blocks 11b and 11c located on either side of block 11a made of a very stiff material are made of an elastic material of lesser stiffness, and this stiffness decreases progressively for the other blocks. Block 11b is extended frontwards by blocks 11d, 11e, 11f, and 11g, which are thus composed of elastic materials whose stiffness decreases progressively. Similarly, block 11c is extended rearward by blocks 11h and 11i, which are made of elastic materials of decreasing stiffness. The widths of the different blocks 11a to 11i may be the same, or they may decrease progressively forward and rearward beginning with block 11a made of the very stiff material.

Figure 6:
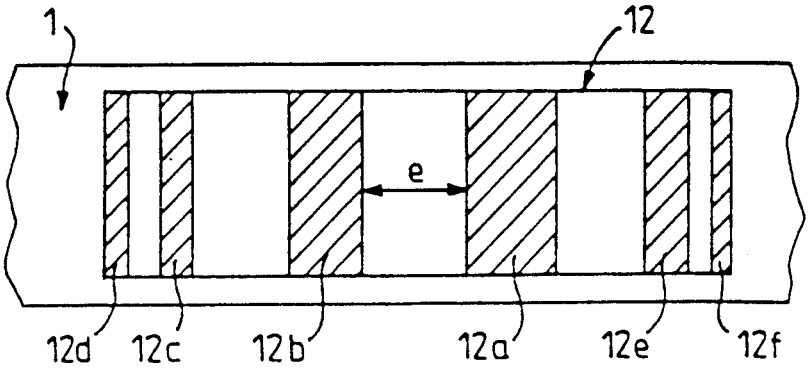

In the embodiment shown in FIG. 6, the layer of elastic shock-absorbing material 12 is constituted by several distinct rectangular blocks made of the same elastic material, longitudinally spaced from each other and of variable widths. An intermediate block, 12a, of relatively great width, is positioned where the maximum stiffness is desired. Layer 12 comprises other blocks 12b, 12c, 12d placed in front of block 12a and other blocks 12e, 12f positioned in back of this block. The widths of blocks 12b, 12c, 12d positioned forward of block 12a decrease progressively, the width of block 12b being less than that of the intermediate block 12a. Similarly, the widths of blocks 12e, 12f decrease progressively toward the rear.

Spacing e between the blocks may be uniform or may increase or decrease progressively, as required.

Other means may be provided to vary longitudinally the physical properties of the layer of shock-absorbing material, so as to obtain a uniform variation in the stiffness of the layer. More or less elastic elements may, in particular, be incorporated into the layer during manufacture, the percentages of the incorporated elements varying as a function of the desired stiffness variation curve.

What is claimed is:

1. A device for mounting a ski boot (2) on a ski (1), said boot being held in place between two safety bindings (3, 4), respectively, immobilizing a front and a rear of said boot (2), said device comprising an intermediate longitudinal support plate (5) having two end sections on which said two bindings, (3, 4) are mounted, and a longitudinal layer (6, 9, 11, 12) of elastic shock-absorbing material inserted between said intermediate support plate (5) and an upper surface of said ski (1), wherein said layer (6, 9, 11, 12) of elastic shock-absorbing material has a localized stiffness value (R) which varies progressively from a single intermediate zone to a forward end and a rearward end of said layer (6) of shock-absorbing material, said stiffness value being greatest at said single intermediate zone and progressively decreasing from said intermediate zone toward each of said forward and rearward ends.

2. Device according to claim 1, wherein said layer (6) of elastic shock-absorbing material is entirely constituted by a single elastic material of a predetermined stiffness and having a transverse dimension which varies in a longitudinal dimension of said ski.

3. Device according to claim 2, wherein said layer (6) of shock-absorbing material is constituted by two triangular blocks (6a, 6b) which are symmetrical to each other in relation to a longitudinal axis (x--y) of said layer (6) and have a common vertex (6c) on said longitudinal axis (x--y) and two sides parallel to said longitudinal axis (x--y).

4. Device according to claim 3, wherein said triangular spaces (7, 8) delimited by said two triangular blocks (6a, 6b) are left empty.

5. Device according to claim 3 filled with a foam-type substance whose thickness is virtually zero.

6. Device according to claim 1, wherein said layer (9) of elastic shock-absorbing material has holes (9a) whose sizes vary along a longitudinal dimension of said ski.

7. Device according to claim 6, wherein those of said holes (9a) closest to forward (9b) and rearward ends of said layer (9) are the largest, in order to produce at said forward and rearward ends in said layer (9) a low degree of stiffness, and wherein the size of said holes (9a) decreases progressively up to said intermediate zone where the stiffness must be at a maximum.

8. Device according to claim 1, wherein said layer (11) of elastic shock-absorbing material is constituted by a succession of rectangular blocks (11a, 11b, 11c, 11d, 11e, 11f, 11g, 11h, 11i) which have the same extension in the transverse dimension of said ski, are attached to each other in the longitudinal dimension of said ski, and have different stiffnesses.

9. Device according to claim 1, wherein said layer (12) of elastic shock-absorbing material is constituted by several separate rectangular blocks made of a single elastic material and spaced apart longitudinally, an intermediate block (12*a*) of substantial width being placed where maximum stiffness is desired, and other blocks (12*b*, 12*c*, 12*d*) positioned in front of said intermediate block (12*a*) and additional blocks (12*e*, 12*f*) placed in back of said block having widths which decrease progressively toward the ends of said layer (12).

10. Device according to claim 4, wherein the spacing (e) between said blocks (12*a* to 12*f*) decreases progressively beginning at said intermediate block (12*a*) in the direction of the two ends of said layer (12).

* * * * *